US009757798B2

(12) United States Patent
Gisler et al.

(10) Patent No.: US 9,757,798 B2
(45) Date of Patent: Sep. 12, 2017

(54) SLIDING CLOSURE AT THE SPOUT OF A CONTAINER CONTAINING A MOLTEN METAL, AND METHOD FOR SETTING CLOSURE PLATES IN THE SLIDING CLOSURE

(71) Applicant: Refrectory Intellectual Property GmbH & Co. KG, Vienna (AT)

(72) Inventors: Rebecca Gisler, Hünenberg See (CH); Jean-Daniel Cousin, Lucerne (CH); Benno Steiner, Nebikon (CH)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 221 days.

(21) Appl. No.: 14/432,070

(22) PCT Filed: Oct. 9, 2013

(86) PCT No.: PCT/EP2013/071081
§ 371 (c)(1),
(2) Date: Mar. 27, 2015

(87) PCT Pub. No.: WO2014/056994
PCT Pub. Date: Apr. 17, 2014

(65) Prior Publication Data

US 2015/0246392 A1 Sep. 3, 2015

(30) Foreign Application Priority Data

Oct. 11, 2012 (CH) ..... 1928/12

(51) Int. Cl.
*B22D 41/32* (2006.01)
*B22D 41/24* (2006.01)
(Continued)

(52) U.S. Cl.
CPC ..... *B22D 41/24* (2013.01); *B22D 11/10* (2013.01); *B22D 41/34* (2013.01); *B22D 41/38* (2013.01);
(Continued)

(58) Field of Classification Search
CPC ..... B22D 41/34
(Continued)

(56) References Cited

U.S. PATENT DOCUMENTS 4,867,428 A * 9/1989 Fricker ..... B22D 41/34 222/591
8,371,484 B2 2/2013 Keller et al.
(Continued)

FOREIGN PATENT DOCUMENTS

JP S50121131 U 9/1975
JP H11-57991 A 3/1999
(Continued)

OTHER PUBLICATIONS

Abstract of JP 2000-141024 A.
Abstract of JPH11-57991.

*Primary Examiner* — Scott Kastler
(74) *Attorney, Agent, or Firm* — Brian Roffe

(57) ABSTRACT

Slide closure for a vessel containing molten metal includes a slide housing and a slide unit that can be displaced longitudinally towards the slide housing, at least one refractory closure plate can respectively be inserted into the slide housing. The closure plates can be pressed against one another by the slide unit being braced against the slide housing. The closure plates can respectively be fixed or centered therein by a placement device having a displaceable positioning element. These placement devices are respectively designed such that upon bracing the slide unit against the slide housing, placing of the positioning element
(Continued)

and clamping or centering of the respective closure plate is brought about therein. Therefore, despite easier operation, increased operating reliability is guaranteed because the closure plates are clamped and centered mechanically.

20 Claims, 3 Drawing Sheets

(51) Int. Cl.

| | |
|---|---|
| ***B22D 41/34*** | (2006.01) |
| ***B22D 41/40*** | (2006.01) |
| ***B22D 11/10*** | (2006.01) |
| ***B22D 41/38*** | (2006.01) |

(52) U.S. Cl.
CPC ..... *B22D 41/40* (2013.01); *Y10T 29/49826* (2015.01)

(58) Field of Classification Search
USPC ..... 222/600
See application file for complete search history.

(56) References Cited

U.S. PATENT DOCUMENTS

| | | | | |
|---|---|---|---|---|
| 8,740,024 | B2 | 6/2014 | Steiner et al. | |
| 8,795,583 | B2 | 8/2014 | Heller et al. | |
| 8,887,969 | B2 | 11/2014 | Steiner et al. | |
| 2005/0040572 | A1* | 2/2005 | Keller ..... | B22D 41/34 266/271 |
| 2010/0199566 | A1 | 8/2010 | Keller et al. | |
| 2011/0127265 | A1 | 6/2011 | Steiner et al. | |
| 2011/0127302 | A1 | 6/2011 | Steiner et al. | |
| 2012/0119486 | A1 | 5/2012 | Steiner et al. | |
| 2012/0217272 | A1 | 8/2012 | Steiner et al. | |
| 2012/0325868 | A1 | 12/2012 | Gisler | |
| 2013/0270308 | A1 | 10/2013 | Steiner et al. | |
| 2013/0299119 | A1 | 11/2013 | Heller et al. | |
| 2015/0246392 | A1* | 9/2015 | Gisler ..... | B22D 41/24 222/600 |

FOREIGN PATENT DOCUMENTS

| | | | |
|---|---|---|---|
| JP | 2000141024 | A | 5/2000 |
| WO | 2014056994 | A1 | 4/2014 |

* cited by examiner

SLIDING CLOSURE AT THE SPOUT OF A CONTAINER CONTAINING A MOLTEN METAL, AND METHOD FOR SETTING CLOSURE PLATES IN THE SLIDING CLOSURE

FIELD OF THE INVENTION

The invention relates to a slide closure for a vessel containing molten metal that includes a slide housing, and a slide unit that can be displaced longitudinally towards the slide housing, wherein a refractory closure plate is insertable into the slide housing and/or slide unit and when two are present, are operatively pressed against one another by the slide unit being braced against the slide housing. The invention also relates to a method for placing closure plates in the slide closure for a vessel containing molten metal wherein a longitudinally displaceable slide unit is braced against a slide housing by means of a drive, wherein a respective refractory closure plate is inserted into the slide housing and slide unit. The refractory closure plates are pressed against one another.

BACKGROUND OF THE INVENTION

It is well known that the refractory closure plates in a slide closure have to be changed frequently because they are subjected to a high degree of wear due to the molten metal flowing through the latter when pouring. For this reason the slide closure has to be opened and closed again frequently, and this is labour-intensive.

In a slide closure according to publication WO-A-2004/069448 there is provided a clamping device for a refractory plate in which three of the clamping elements are in the form of clamping shoes mounted pivotably in the slide housing, and the fourth clamping element has a clamping jaw that can be adjusted in the direction of the corresponding closure plate side surface and which is mounted flexibly in the slide housing and is guided displaceably by a bracing means towards the side surface. This clamping jaw is arranged adjustably in a base body fixed securely in the housing, there being provided for its adjustment a rotatably adjustable eccentric the axis of rotation of which runs transversely to the direction of adjustment of the clamping jaw. Therefore, the closure plates have to be braced manually.

OBJECTS AND SUMMARY OF THE INVENTION

The object underlying the present invention is to improve a slide closure such that replacement of the refractory closure plates in the slide housing or in the slide unit can also take place efficiently with assumed fixing and centring of the latter.

The object is achieved according to the invention by a slide closure including a placement device positioned within the slide housing or within the slide unit and each of which is designed such that upon bracing the slide unit against the slide housing, placement of the positioning element, and clamping or centering of the respective closure plate is obtained. In a method, the slide unit is braced against the slide housing by means of the drive and only after this bracing are the closure plates either clamped or centered within the slide housing or within the slide unit.

By means of this design according to the invention of the respective placement device within the slide housing or in the slide unit in which, by bracing the slide unit against the slide housing, as it were, placing of the positioning element and so clamping and centring of the respective closure plate is brought about therein, the closure plates on the ladle seat can be easily placed therein or be inserted into the slide housing, and after pivoting the slide unit against the slide housing automatic clamping or centring of the closure plates takes place.

Therefore, despite easier operation, increased operating reliability is guaranteed because the closure plates are clamped and centred mechanically and so no mis-manipulations, as can take place when clamping manually, can occur.

In the method according to the invention wherein initially the slide unit is braced against the slide housing and only then are the closure plates clamped and centred therein, it is advantageous that the closure plates rest correctly within the slide unit or within the slide housing and so no tilting of the latter occurs.

BRIEF DESCRIPTION OF THE DRAWINGS

One exemplary embodiment of the invention and further advantages of the latter are described in more detail below by means of the drawings. These show as follows.

DETAILED DESCRIPTION OF THE INVENTION

Figure 1:
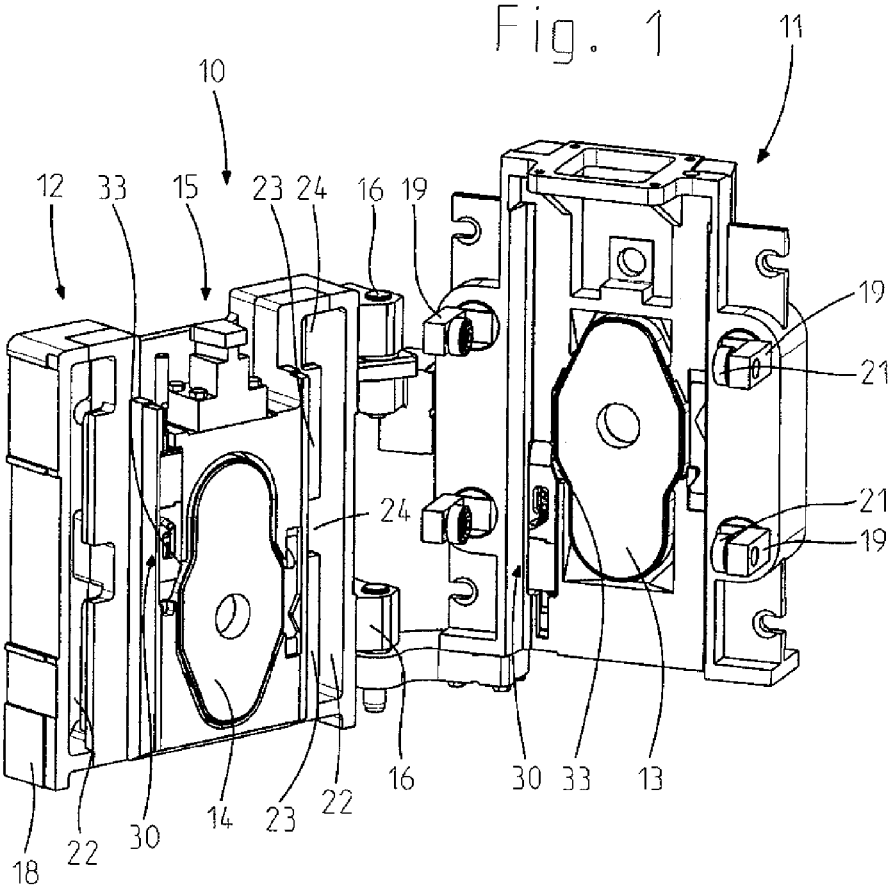
FIG. 1 is a slide closure according to the invention in a pivoted open open position, illustrated perspectively.

FIG. 1 shows a slide closure 10 which can be mounted on a spout of a vessel (not detailed). The vessel is in particular a ladle of a continuous casting line containing molten steel. Needless to say, however, a tundish, a converter vessel or similar can also be provided.

The slide closure 10 is provided with a slide housing 11 and a slide unit 12 that can be displaced longitudinally towards the latter, in which a refractory closure plate 13, 14 can respectively be inserted. The slide unit 12 is held pivotably by means of hinges 16 attached to the side of the slide housing 11. If the slide unit 12 is now pivoted towards the slide housing 11, the sliding surfaces of the inserted closure plates 13, 14 come into contact with one another.

The closure plates 13, 14 can respectively be fixed or centered by means of a placement device 30 having a displaceable positioning element 33, i.e., they can thereby be clamped in the slide housing 11 or in the slide unit 12 as required or be centered therein with hardly any play.

Fastened to the outside of the slide housing 11 are four supports 19 with inwardly directed guide rollers 21 which are intended to engage in corresponding longitudinal grooves 22 on the slide unit 12 when the latter is pivoted towards the slide housing 11, and these two are braced against one another. These guide rollers 21 are then guided in these longitudinal grooves 22 on inside guide tracks 23 and are pressed against the slide housing 11 by spring components of the frames 18 contained in these supports 19.

In a way known in its own right the guide tracks 23 are interrupted by corresponding recesses 24 by means of which the guide rollers 21 can be pushed into the longitudinal grooves 22, and in addition, for each guide roller 21, they are each provided with an obliquely extending ramp. When the guide rollers are introduced into these recesses 24 the slide unit 12 is displaced via the drive coupled to it into a position lying outside of the open and the closed position and the guide rollers 21 slide along these ramps by means of which the spring components are clamped and so the slide unit is braced against the slide housing, upon releasing, this slide unit being displaced in the opposite direction.

In the braced state of the slide closure 10, the slide unit 12 with the slide 15 is moved to and fro by means of a drive (not detailed), and so the slide closure 10 is fully opened and restricted or closed, depending on the position of the flow-through openings of the closure plates 13, 14 in relation to one another.

According to the invention, this placement device 30 positioned within the slide housing 11 or within the slide unit 12 is designed such that upon bracing the slide unit 12 against the slide housing 11, placement, as it were, of the respective positioning element 33 and so clamping and centering of the respective closure plate 13, 14 within the slide housing or the slide unit 12 is brought about.

The invention is characterized by this automatic clamping and centering of the closure plates by means of which the closure plates are only inserted into the slide housing and slide unit and no additional manual action has to be taken.

Figure 2:
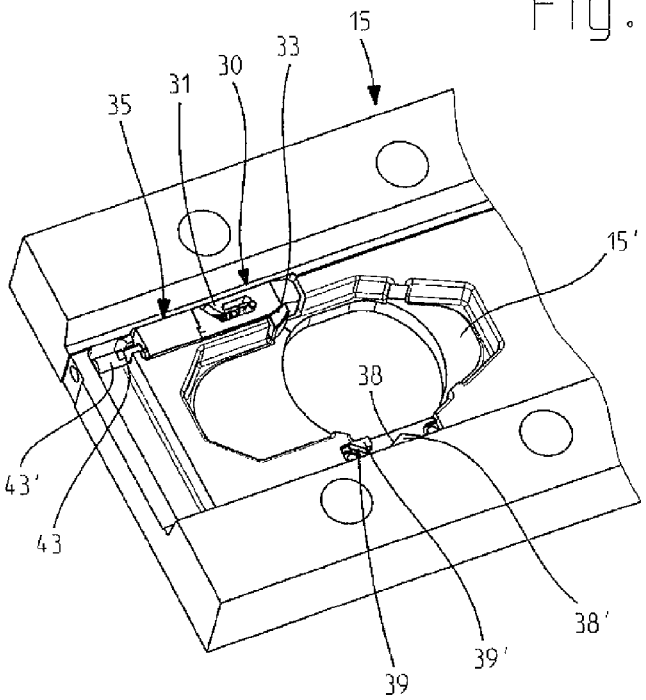
FIG. 2 is a perspective view of part of the slide unit according to FIG. 1.

FIG. 2 shows the slide unit 12 with the opening 15' holding the closure plate 14 and the inserted placement device 30 with the projecting cams 38', 39' arranged opposite and guide tracks 38, 39 formed on the latter. The respective placement device 30 can be inserted with its housing 35 as a replaceable clamping and placement module in the slide unit or in the slide housing. It is inserted almost with form closure in a recess in the slide unit 12 and is fixed automatically therein by the positioning element 33 being held in a corresponding widening groove by means of a cam 43' by axially displacement into the bracing or centring position with its longitudinal part 43 projecting on the other end of the housing 35.

The guide tracks 38, 39 formed on the slide unit 15 co-operate with the carrier element or the locking means of the placement device 30 in the slide housing 11 and conversely the guide tracks in the slide housing 11 co-operate with the carrier element or the locking means of the placement device in the slide unit (not detailed).

This placement device 30 with the positioning element 33 clamps the respective closure plate 13, 14 against preferably three respective fixed stop surfaces in openings 15' in the slide housing 11 or in the slide unit 15.

It is evident from FIG. 3 to FIG. 6 that each respective placement device 30 comprises a housing 35, the positioning element 33 displaceable transversely within the housing 35, a last clamping component 32 displaceable into the clamping and placement position, a carrier element 31 guided in a groove 36, 36' in the housing 35 and a locking means 37 guided in the groove 36, 36; and the guide tracks 38, 39 on the cams 38', 39' co-operating with the carrier element 31 and the locking means 37.

In the placement device 30 a longitudinal part 43 is guided axially within the housing 35 and the positioning element 33 connected operatively to the latter is guided with transverse displacement. In addition, this carrier element 31 and the locking means 37 are held against this longitudinal part 43. The clamping component 32 in the form of a compression spring rests on the face side against one end of the housing 35 and on the other end against this locking means 37. The carrier element 31 guided in this groove 36, 36' is disposed projecting towards the housing 35 and is in contact with the guide tracks 38, 39 of the cams 38', 39' projecting on the slide housing depending on the position of the slide unit 12 in relation to the slide housing 11.

These guide tracks 38, 39 formed on the projecting cams 38', 39' on the slide unit 12 or on the slide housing 11 are arranged such that on the one hand the positioning element 33 is placed on the corresponding closure plate 13, 14 by displacing the slide unit or is released from the latter.

Figure 3:
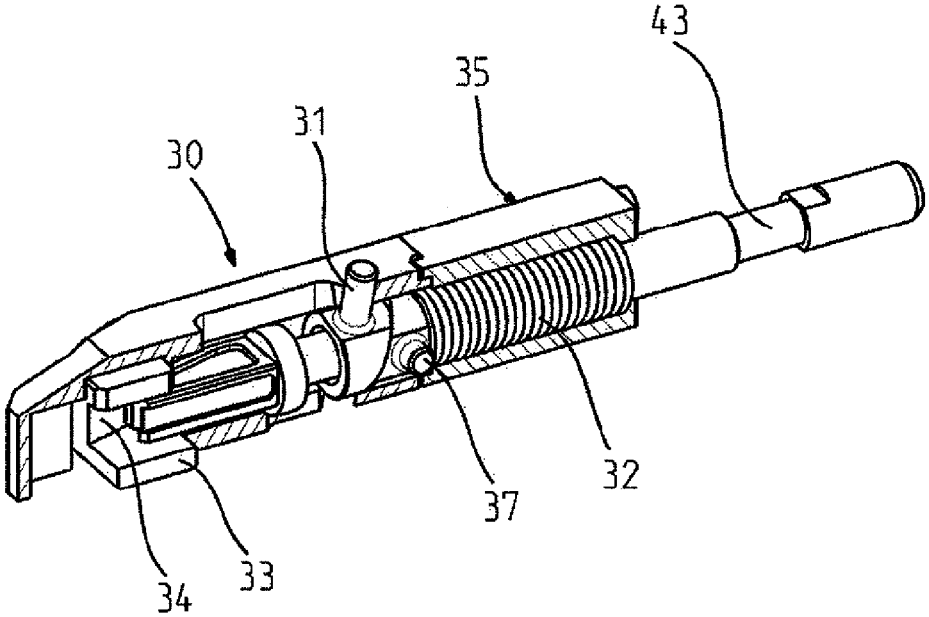
FIG. 3 is a perspective view of the placement device according to FIG. 2 shown in the non-braced position, with a longitudinal section of its housing.
Figure 4:
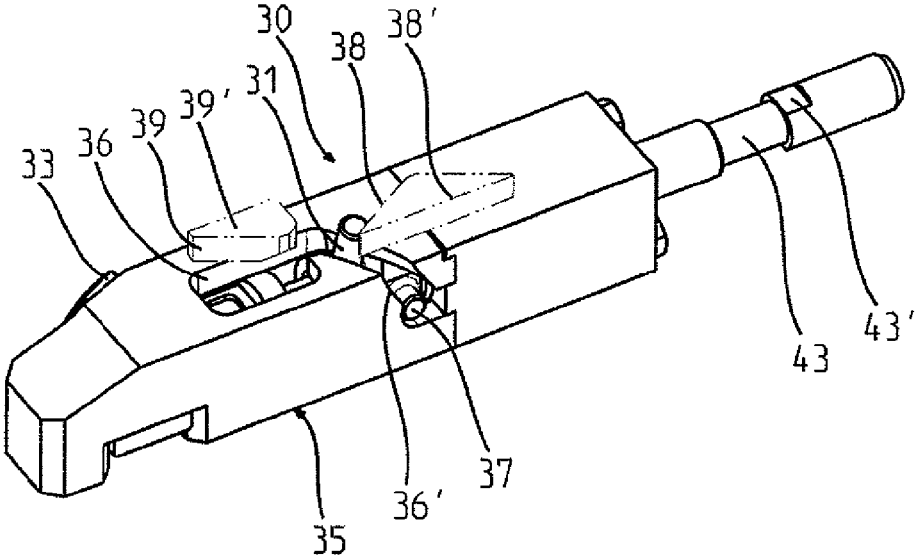
FIG. 4 a perspective view of the placement device similar to FIG. 3.

In FIG. 3 and FIG. 4 the positioning element 33 is illustrated in the withdrawn position in which a closure plate can be inserted, for example, into the opening 15' of the slide unit 12. Here the locking means 37 is in the locked position in which the longitudinal part 43, the clamping component 32 and also the carrier element 31 are also in the withdrawn position.

By displacing the slide unit 12 pivoted towards the slide housing 11 the housing 35 moves with the latter in the axial direction of the longitudinal part. With its guide track 38 the cam 38' on the slide housing 11 indicated in FIG. 4 causes the carrier element 31 to be pushed into the axially extending groove 36 in this oblique groove 36' and so also causes the locking means 37 to be moved into this oblique groove 36. This brings about release of this locking and consequently the carrier element, the locking means, the longitudinal part and the positioning element are moved by the clamping component 32 into the position according to FIG. 5 or FIG. 6. The positioning element 33 is pushed outwards by a corresponding oblique surface 34 on the longitudinal part 43 so that self-retention is achieved between the latter and so release is prevented in the operating state.

Figure 5:
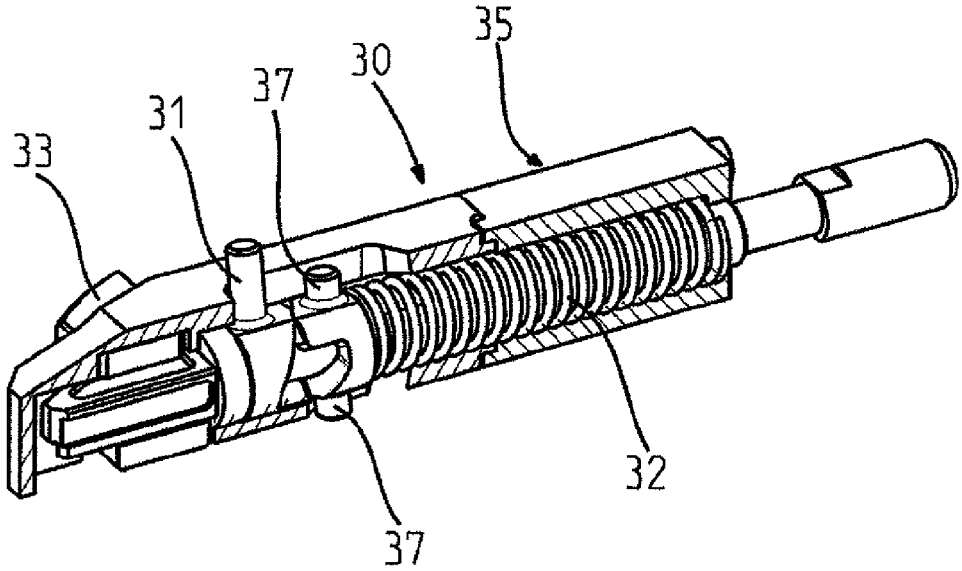
FIG. 5 is a perspective view of the placement device according to FIG. 2 in the clamping position, with a longitudinal section of its housing.
Figure 6:
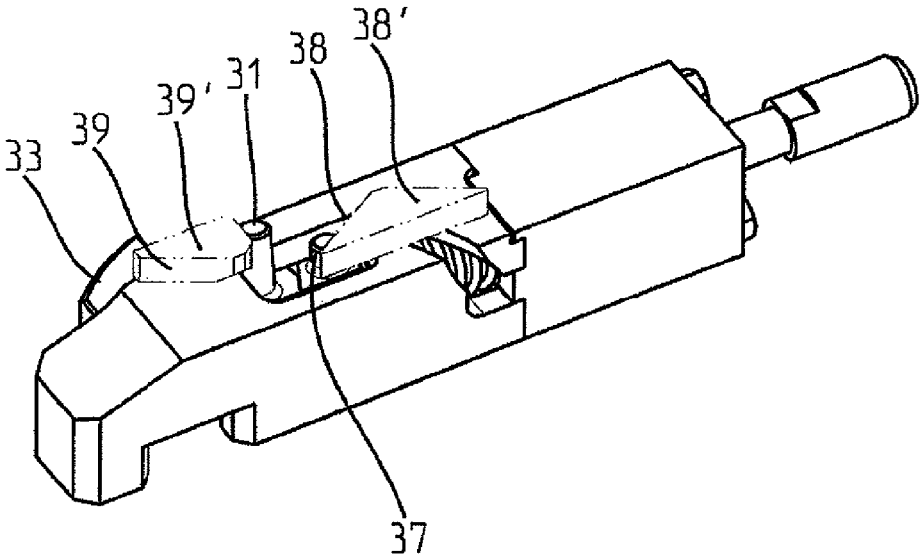
FIG. 6 is a perspective view of the placement device similar to FIG. 5.

In this clamping and placement position of the placement device 30 according to FIG. 5 and FIG. 6 the housing 35 is conversely in turn moved with the slide unit 12 in the axial direction of the long part when said slide unit 12 is released. With its guide track 39, the cam 39' on the slide housing 11 indicated in FIG. 6 causes the carrier element 31 and the aforementioned parts associated with it to be brought along the axially extending groove 36 into this oblique groove 36' by the axial movement of the housing 35 and so the locking means 37 is moved back into the locking position according to FIG. 4.

In the method according to the invention, the slide unit 12 is pivoted out of the open position illustrated in FIG. 1 onto the slide housing 11 and is then braced against the slide housing 11 by means of the drive, as described in more detail above. Only after this bracing are the closure plates 13, 14 in the slide housing 11 or in the slide unit 12 either clamped or centered by this respective placement device 30.

One is thus offered the further advantage that the closure plates lie correctly in the openings 15' in the slide unit 12 or in the slide housing 11 due to this bracing, and so there is no tilting of the latter, this being a disadvantage with the conventional manual assembly of closure plates.

For this purpose the clamping and placement module and the cams 38', 39' of the placement device 30 are positioned in relation to the inside guide tracks 23 and the ramps or the guide rollers in the slide unit 12 or in the slide housing 11 in the direction of displacement of the slide unit such that first of all the guide rollers 21 slide over the ramps and only then does the respective cam 38' trigger this adjustment of the carrier element 31 and, as it were, of the other parts.

The invention could of course also be illustrated by other embodiments. Thus, with this placement device, the positioning element could be placed such that it is not clamping, but simply centering of the respective closure plate that is brought about. The positioning element would be adjusted to such an extent here that it does not brace the respective closure plate against the other stop surfaces, but it would only bring about almost play-free centering of the closure plates.

In addition, the clamping and centring of the closure plates could be implemented by means of a mechanism (not shown) which executes this by pivoting the slide unit towards the housing, and not only after the latter have both been braced together.

The invention claimed is:

1. A slide closure for a vessel that operatively contains molten metal, comprising:

a slide housing including an opening receivable of a first refractory closure plate;

a slide unit including an opening receivable of a second refractory closure plate and which is displaceable relative to said slide housing, the first refractory closure plate when present in the opening in said slide housing and the second refractory closure plate when present in the opening in said slide unit being pressed against one another when said slide unit is braced against said slide housing; and at least one placement device that fixes or centers a respective one of the first and second refractory closure plates when present in the opening in said slide housing or said slide unit, each of said at least one placement device comprising a displaceable positioning element that is displaced, as a result of bracing of said slide unit against said slide housing, toward the respective one of the first and second refractory closure plates when present in the opening in said slide housing or said slide unit to press the respective one of the first and second refractory closure plates when present in the opening in said slide housing or said slide unit against said slide housing or said slide unit and thereby clamp or center the respective one of the first and second refractory closure plates when present in the opening in said slide housing or said slide unit.

2. The slide closure according to claim 1, wherein said positioning element is configured to extend at least partly into the opening in said slide housing or said slide unit as a result of bracing of said slide unit against said slide housing and thereby engage with the respective one of the first and second refractory closure plates when present in the opening in said slide housing or said slide unit.

3. The slide closure according to claim 1, wherein said at least one placement device comprises a first placement device that fixes or centers the first refractory closure plate when present in the opening in said slide housing, and a second placement device that fixes or centers the second refractory closure plate when present in the opening in said slide unit.

4. The slide closure according to claim 3, wherein said first placement device comprises a housing arranged in said slide housing in which said positioning element is displaceable and which defines a groove, a carrier element guided in said groove within said housing, a locking member guided in a part of said groove within said housing and guide tracks arranged in said slide unit and configured to guide said carrier element or said locking member as a result of the bracing of said slide unit against said slide housing.

5. The slide closure according to claim 3, wherein said first placement device comprises a housing arranged in said slide unit in which said positioning element is displaceable and which defines a groove, a carrier element guided in said groove within said housing, a locking member guided in a part of said groove within said housing and guide tracks arranged in said slide housing and configured to guide said carrier element or said locking member as a result of the bracing of said slide unit against said slide housing.

6. The slide closure according to claim 1, wherein each of said at least one placement device further comprises a housing in which said positioning element is displaceable and which defines a groove, a carrier element guided in said groove within said housing, a locking member guided in a part of said groove within said housing and guide tracks configured to guide said carrier element or said locking member as a result of the bracing of said slide unit against said slide housing.

7. The slide closure according to claim 6, wherein said groove includes an oblique part in which said locking member is guided and said positioning element is moved at least partly within said housing.

8. The slide closure according to claim 6, wherein each of said at least one placement device further comprises a clamping component having a bracing position in which said at least one placement device fixes or centers the respective one of the first and second refractory closure plates when present in the opening in said slide housing or said slide unit, and a placement position in which the respective one of the first and second refractory closure plates is movable into or out of the opening in said slide housing or said slide unit.

9. The slide closure according to claim 8, wherein said clamping component comprises a compression spring.

10. The slide closure according to claim 9, wherein said compression spring rests against said housing at one end and against said locking member at an opposite end.

11. The slide closure according to claim 6, wherein said at least one placement device fixes or centers the first refractory closure plate when present in the opening in said slide housing, said housing of said at least one placement device being arranged in said slide housing, said guide tracks of said at least one placement device being formed on said slide unit.

12. The slide closure according to claim 6, wherein said at least one placement device fixes or centers the second refractory closure plate when present in the opening in said slide unit, said housing of said at least one placement device being arranged in said slide unit, said guide tracks of said at least one placement device being formed on said slide housing.

13. The slide closure according to claim 6, wherein said guide tracks are formed on projecting cams.

14. The slide closure according to claim 13, wherein said projecting cams selectively engage with said carrier element upon displacement of said slide unit within said slide housing to cause displacement of said positioning element in a first direction to press against the respective one of the first and second refractory closure plates when present in the opening in said slide housing or said slide unit and to cause displacement of said positioning element in a second direction to release pressure by said positioning element against the respective one of the first and second refractory closure plates when present in the opening in said slide housing or said slide unit.

15. The slide closure according to claim 13, wherein said slide unit includes a respective guide track and associated ramp on both sides of said opening and said slide housing includes guide rollers configured to slide on said guide tracks when said slide unit is braced against said slide housing, and wherein said housing and said projecting cams are positioned in relation to said guide tracks, and said associated ramps of said slide unit and said guide rollers are positioned within said slide unit or said slide housing in a direction of displacement of said slide unit such that said guide rollers first slide over said associated ramps and only thereafter said projecting cams engage with said carrier elements.

16. The slide closure according to claim 1, wherein said slide housing includes a recess, said at least one placement device fitting into said recess.

17. The slide closure according to claim 16, wherein each of said at least one placement device further comprises a longitudinal part connected to said positioning element that fixes said housing in said recess, said longitudinal part including a cam that limits axial displacement of said positioning element.

18. The slide closure according to claim 1, wherein said slide unit includes a recess, said at least one placement device fitting into said recess.

19. The slide closure according to claim 18, wherein each of said at least one placement device includes a longitudinal part connected to said positioning element that fixes said housing in said recess, said longitudinal part including a cam that limits axial displacement of said positioning element.

20. The slide closure according to claim 1, wherein said slide unit includes a respective guide track on both sides of said opening and said slide housing includes guide rollers which slide on said guide tracks when said slide unit is braced against said slide housing, said slide unit further including recesses interrupting said guide tracks.

* * * * *